US010344529B2

(12) United States Patent
Hsieh

(10) Patent No.: US 10,344,529 B2
(45) Date of Patent: Jul. 9, 2019

(54) BLIND AND TILT MECHANISM THEREOF

(71) Applicant: FRESH SPRING INTERNATIONAL, INC., New Taipei (TW)

(72) Inventor: Chih-Ming Hsieh, New Taipei (TW)

(73) Assignee: FRESH SPRING INTERNATIONAL, INC., New Taipei (TW)

( * ) Notice: Subject to any disclaimer, the term of this patent is extended or adjusted under 35 U.S.C. 154(b) by 239 days.

(21) Appl. No.: 15/655,824

(22) Filed: Jul. 20, 2017

(65) Prior Publication Data

US 2018/0371831 A1 Dec. 27, 2018

(30) Foreign Application Priority Data

Jun. 21, 2017 (TW) ..... 106208972 U

(51) Int. Cl.
*E06B 9/307* (2006.01)
*E06B 9/304* (2006.01)
*E06B 9/28* (2006.01)

(52) U.S. Cl.
CPC ..... *E06B 9/307* (2013.01); *E06B 9/304* (2013.01); *E06B 2009/285* (2013.01)

(58) Field of Classification Search
CPC . E06B 9/307; E06B 9/304; E06B 9/32; E06B 9/322; E06B 2009/285
See application file for complete search history.

(56) References Cited

U.S. PATENT DOCUMENTS 3,878,877 A * 4/1975 Bruneau ..... E06B 9/361 160/168.1 R
4,224,973 A * 9/1980 Hugin ..... E06B 9/361 160/176.1 V
4,621,672 A * 11/1986 Hsu ..... E06B 9/307 160/115
5,501,116 A * 3/1996 Weng ..... E06B 9/364 160/174 V
5,575,323 A * 11/1996 Smuckler ..... E06B 9/361 160/177 V
5,671,794 A * 9/1997 Nien ..... E06B 9/36 160/330
5,992,495 A * 11/1999 Cadorette ..... E06B 9/364 160/168.1 V
6,076,587 A * 6/2000 Pastor ..... E06B 9/307 160/115
6,112,798 A * 9/2000 Cheng ..... E06B 9/36 160/174 V (Continued)

*Primary Examiner* — Brent W Herring
(74) *Attorney, Agent, or Firm* — Maschoff Brennan

(57) ABSTRACT

A tilt mechanism for a blind includes a spool, two transmission shafts, two transmission sleeves and a driven shaft. The spool has an inner gear. Each transmission shaft has an assembling portion and a gear. The gears are engaged with the inner gear. The transmission sleeves are respectively engaged with the assembling portions of the transmission shafts, and each transmission sleeve has an outer surface and a worm gear located at the outer surface thereof. The driven shaft has a teeth portion, and the teeth portion is engaged with the worm gear. The transmission shafts and the transmission sleeves are simultaneously rotatable by being driven by the spool, and the driven shaft is rotatable between a start position and a stop position along an operating direction by being driven by the transmission sleeves.

11 Claims, 8 Drawing Sheets

(56) References Cited

U.S. PATENT DOCUMENTS

| | | | | |
|---|---|---|---|---|
| 6,854,503 | B2 * | 2/2005 | Cross | E06B 9/322<br>160/168.1 R |
| 7,128,126 | B2 * | 10/2006 | Smith | E06B 9/262<br>160/319 |
| 7,578,334 | B2 * | 8/2009 | Smith | E06B 9/262<br>160/121.1 |
| 9,062,492 | B2 * | 6/2015 | Yu | E06B 9/322 |
| 9,797,191 | B2 * | 10/2017 | Huang | E06B 9/322 |
| 2004/0226663 | A1 * | 11/2004 | Smith | E06B 9/262<br>160/84.05 |
| 2006/0272783 | A1 * | 12/2006 | Smith | E06B 9/262<br>160/121.1 |
| 2007/0051477 | A1 * | 3/2007 | Fraser | E06B 9/262<br>160/84.05 |
| 2016/0017964 | A1 * | 1/2016 | Yu | E06B 9/32<br>160/168.1 P |
| 2017/0241198 | A1 * | 8/2017 | McNeill | E05F 11/32 |

* cited by examiner

BLIND AND TILT MECHANISM THEREOF

CROSS-REFERENCE TO RELATED APPLICATIONS

This non-provisional application claims priority under 35 U. S. C. § 119(a) on Patent Application No(s). 106208972 filed in Taiwan on Jun. 21, 2017, the entire contents of which are hereby incorporated by reference.

TECHNICAL FIELD

The disclosure relates to a blind, more particularly to an adjustable blind and a tilt mechanism thereof.

BACKGROUND

Blinds are widely used in various places. A blind is made up of several slats which are able to be gathered at a side of the window to reveal the view or be simply angled while allowing some light to travel through the blind yet retaining some level of privacy. These slats can be angled by pulling a draw cord. In detail, the draw cord is coiled on a spool which is connected to a worm rod, and the worm rod is engaged with a worm gear. When the spool is rotated by the draw cord, the spool can angle the slats through driving the worm gear and the worm rod. It is noted that the slats are only allowed to be pivoted between a fully closed position and a fully opened position, the fully closed position is when the slats are pivoted to fully cover the window, and the fully opened position is when the slats are angled to reveal the view of the window.

SUMMARY

One embodiment of the disclosure provides a tilt mechanism for a blind including a base, a spool, two transmission shafts, two transmission sleeves and a driven shaft. The spool is rotatably disposed on the base, and has an inner gear. The transmission shafts are rotatably disposed on the base. Each transmission shaft has an assembling portion and a gear. The gear is engaged with the inner gear. The transmission sleeves are respectively engaged with the assembling portions of the transmission shafts, and each transmission sleeve has an outer surface and a worm gear located at the outer surface. The driven shaft has a teeth portion, and the teeth portion is engaged with the worm gear. Furthermore, the transmission shafts and the transmission sleeves are simultaneously rotatable by being driven by the spool, and the driven shaft is rotatable between a start position and a stop position along an operating direction by being driven by the transmission sleeves.

One embodiment of the disclosure provides a tilt mechanism for a blind including a base, a spool, at least one transmission shaft, at least one transmission sleeve set and a driven shaft. The spool is rotatably disposed on the base and has an inner gear. The at least one transmission shaft is rotatably disposed on the base. The at least one transmission shaft has an assembling portion and a gear, and the gear is located at one end of the at least one transmission shaft and engaged with the inner gear. The at least one transmission sleeve set includes an inner sleeve and an outer sleeve. The inner sleeve is engaged with the assembling portion. The outer sleeve is sleeved on the inner sleeve, and the inner sleeve is rotatable with respect to the outer sleeve or rotatable simultaneously with the outer sleeve. The outer sleeve has an outer surface and a worm gear located at the outer surface thereof. The driven shaft has a teeth portion, and the teeth portion is engaged with the worm gear. Furthermore, the at least one transmission shaft and the at least one transmission sleeve set are simultaneously rotatable by being driven by the spool, and the driven shaft is rotatable between a start position and a stop position along an operating direction by being driven by the at least one transmission sleeve set. When the driven shaft is rotated to the stop position and the at least one transmission shaft continues to be rotated by the spool, the inner sleeve is rotated with respect to the outer sleeve.

One embodiment of the disclosure provides a blind including a headrail, a tilt mechanism, at least one lift cord and a plurality of slats. The tilt mechanism is disposed on the headrail. The lift cord is disposed on the tilt mechanism, and is connected to all the plurality of slats to make the slats to be hanged on one side of the headrail and spaced apart from each other. The tilt mechanism includes a base, a spool, at least one transmission shaft, at least one transmission sleeve set and a driven shaft. The spool is rotatably disposed on the base, and has an inner gear. The at least one transmission shaft is rotatably disposed on the base. The at least one transmission shaft has a gear and an assembling portion. The gear is located at one end of the at least one transmission shaft and engaged with the inner gear. The at least one transmission sleeve set includes an inner sleeve and an outer sleeve. The inner sleeve is disposed on the assembling portion. The outer sleeve is sleeved on the inner sleeve, and the inner sleeve is rotatable with respect to the outer sleeve or rotatable simultaneously with the outer sleeve. The outer sleeve has an outer surface and a worm gear located at the outer surface thereof. The driven shaft has a teeth portion, and the teeth portion is engaged with the worm gear. Furthermore, the at least one transmission shaft and the at least one transmission sleeve set are simultaneously rotatable by being driven by the spool, and the driven shaft is rotatable between a start position and a stop position along an operating direction by being driven by the at least one transmission sleeve set. When the driven shaft is rotated to the stop position and the at least one transmission shaft continues to be rotated by the spool, the inner sleeve is rotated with respect to the outer sleeve.

BRIEF DESCRIPTION OF THE DRAWINGS

The present disclosure will become more fully understood from the detailed description given here in below and the accompanying drawings which are given by way of illustration only and thus are not intending to limit the present disclosure and wherein.

DETAILED DESCRIPTION

Figure 1:
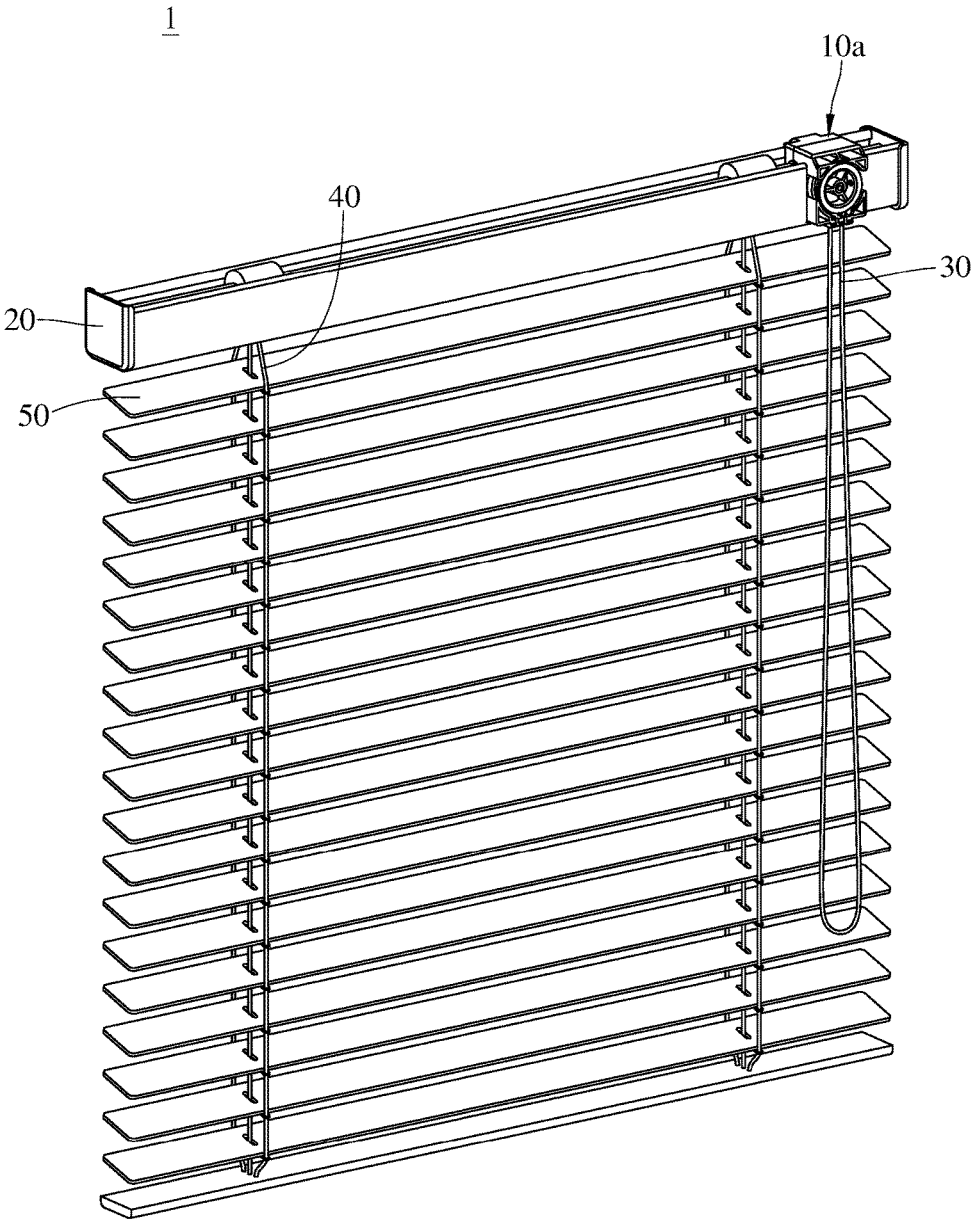
FIG. 1 is a perspective view of a blind with slats in a fully opened position in accordance with one embodiment of the disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
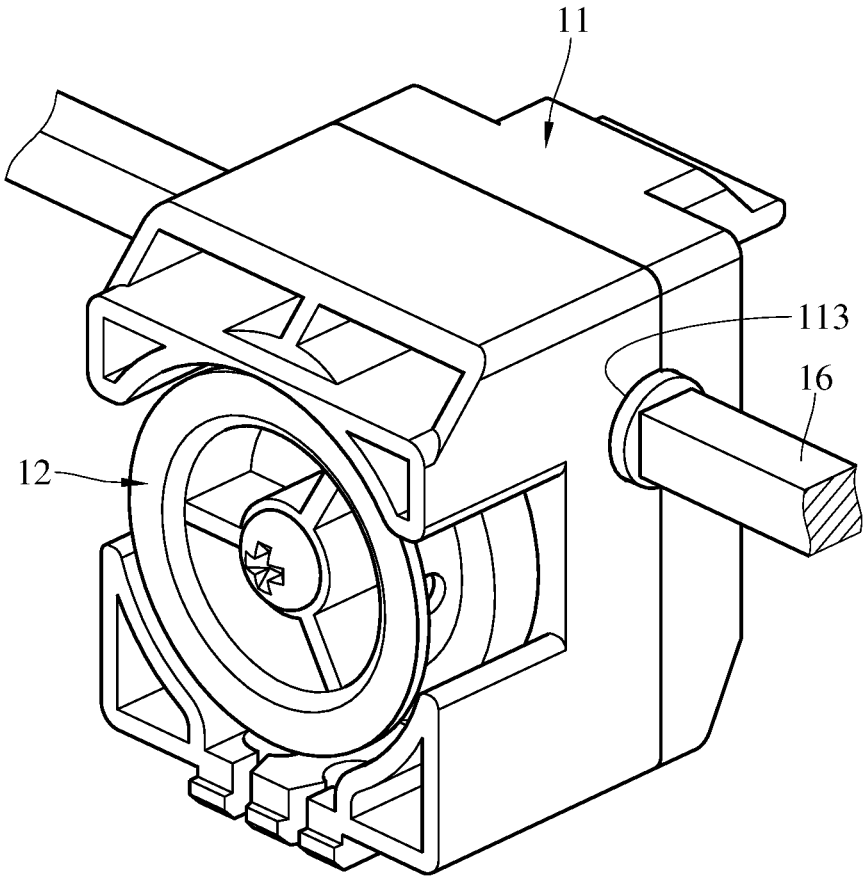
FIG. 2 is a perspective view of a tilt mechanism in FIG. 1.
Figure 3:
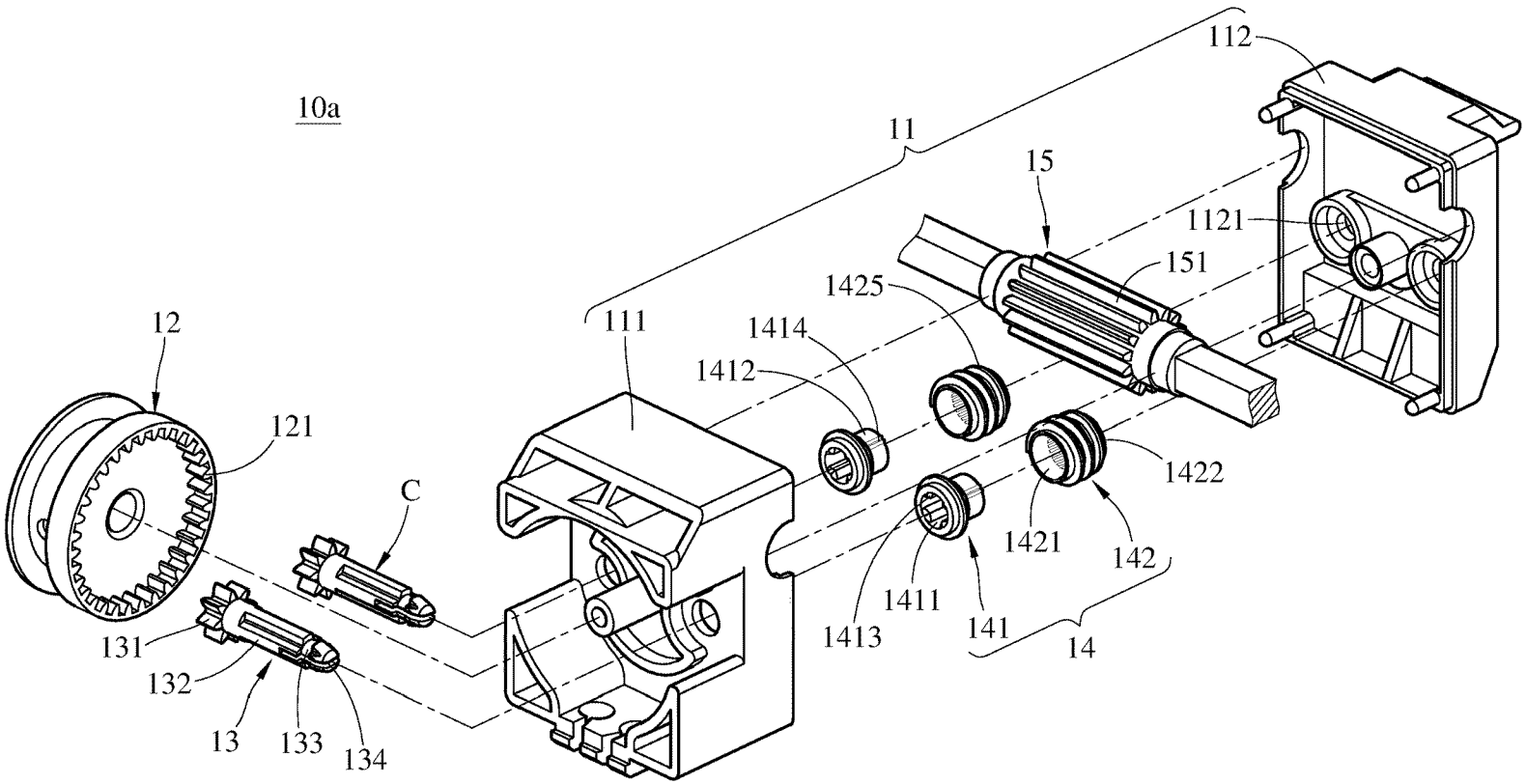
FIG. 3 is an exploded view of the tilt mechanism in FIG. 1.
Figure 4:
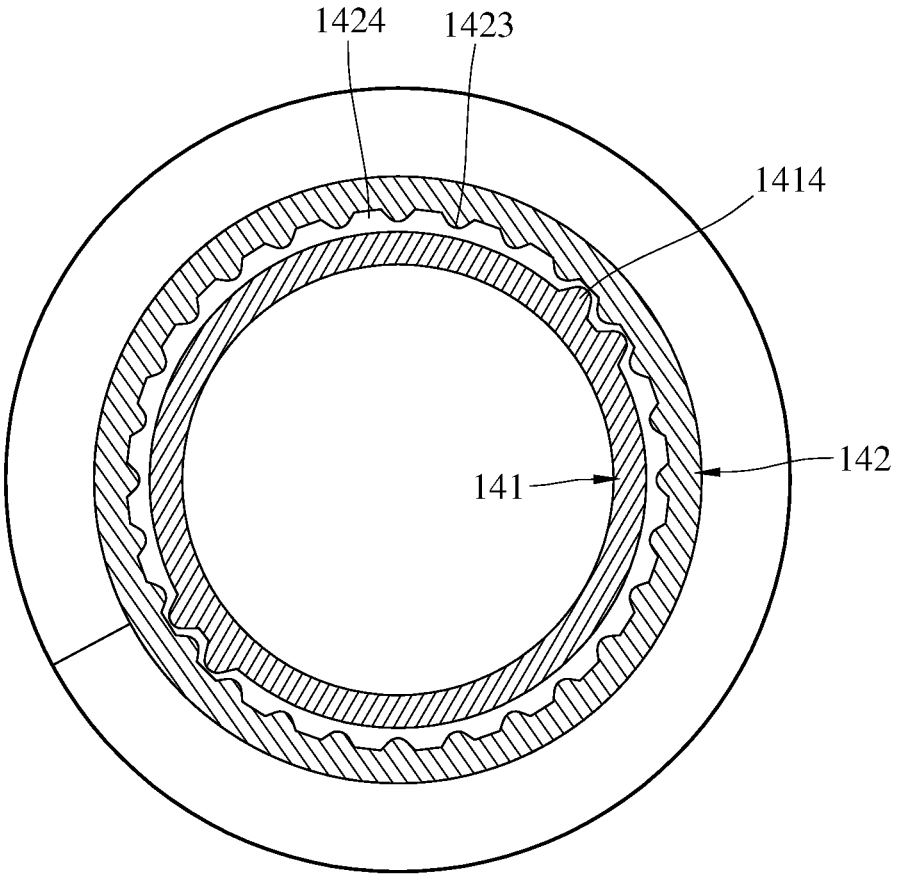
FIG. 4 is a cross-sectional view of an outer sleeve sleeved on the inner sleeve in FIG. 1.

Please refer to FIG. 1 to FIG. 4. FIG. 1 is a perspective view of a blind with slats in a fully opened position in accordance with one embodiment of the disclosure, FIG. 2 is a perspective view of a tilt mechanism in FIG. 1, FIG. 3 is an exploded view of the tilt mechanism in FIG. 1, and FIG. 4 is a cross-sectional view of an outer sleeve sleeved on the inner sleeve in FIG. 1. In this embodiment, a blind 1 is provided. The blind 1 includes a tilt mechanism 10*a*, a headrail 20, a draw cord 30, two lift cords 40 and a plurality of slats 50. The said fully opened position is when the slats are fully opened to reveal the view, it is understood that the slats can be angled to a fully closed position, and the fully closed position is when the slats are fully closed to cover the view.

The tilt mechanism 10*a*, also called cord tilter, is disposed on the headrail 20. The tilt mechanism 10*a* includes a base 11, a spool 12, two transmission shafts 13, two transmission sleeve sets 14, a driven shaft 15 and a tilt rod 16.

The base 11 includes a first body 111 and a second body 112. The second body 112 has a pivoting hole 1121.

The spool 12 is rotatably disposed on the first body 111. The draw cord 30, also called pull cord, is coiled on the spool 12. The draw cord 30 is able to drive the spool 12 to rotate with respect to the base 11. The spool 12 has an inner gear 121.

Each transmission shaft 13 has a gear 131, an assembling portion 132, a pivoting portion 133 and an engaged portion 134 sequentially connected to each other. The gear 131 is engaged with the inner gear 121, such that the spool 12 is able to drive the transmission shaft 13 to rotate. The assembling portion 132 has a key structure C. The engaged portion 134 and the pivoting portion 133 are, for example, formed by two flexible arms which are able to be deformed and moved close to each other so that the engaged portion 134 and the pivoting portion 133 are able to be disposed through the pivoting hole 1121. When these two arms are disposed through the pivoting hole 1121, the pivoting portion 133 is stuck in the pivoting hole 1121. Thus, the transmission shaft 13 is rotatable with respect to the base 11 about the pivoting portion 133.

Each transmission sleeve set 14 includes an inner sleeve 141 and an outer sleeve 142. Each inner sleeve 141 has an inner surface 1411 and an outer surface 1412 opposite to each other. Moreover, each inner sleeve 141 has a plurality of grooves 1413 and a plurality of first protruding portions 1414. The grooves 1413 are located on the inner surface 1411, and the first protruding portions 1414 are located on the outer surface 1412. Each first protruding portion 1414 has a curved surface. Each inner sleeve 141 is sleeved on the assembling portion 132 of the transmission shaft 13, and the key structure C of the assembling portion 132 is engaged into the grooves 1413 on the inner sleeve 141. Hence, the transmission shaft 13 is able to drive the inner sleeve 141 to rotate with respect to the base 11. Each outer sleeve 142 has an inner surface 1421 and an outer surface 1422. Furthermore, the outer sleeve 142 has a plurality of second protruding portions 1423 and a plurality of recesses 1424. The second protruding portions 1423 are located on the inner surface 1421 and the recesses 1424 are formed between the second protruding portions 1423. The amount of the second protruding portions 1423 is more than the amount of the first protruding portions 1414. The outer sleeve 142 has a worm gear 1425 located on the outer surface 1422. The outer sleeve 142 is sleeved on the inner sleeve 141. The inner surface 1421 of the outer sleeve 142 faces the outer surface 1412 of the inner sleeve 141 outer surface 1412, and the first protruding portions 1414 are located in some of the recesses 1424.

Furthermore, a height of the second protruding portion 1423 from the inner surface 1421 of the outer sleeve 142 is smaller than a height of the first protruding portion 1414 from the outer surface 1412 of the inner sleeve 141, and each second protruding portion 1423 has a curved surface. Hence, when a torque that the transmission shaft 13 applies on the inner sleeve 141 is not enough to overcome the restricting force of the recesses 1424 to the first protruding portions 1414, the first protruding portions 1414 are stuck in the recesses 1424, allowing the inner sleeve 141 and the outer sleeve 142 to be rotated simultaneously. When the torque overcomes the restricting force, the first protruding portions 1414 are able to be removed from the recesses 1424 and slide over the curved surfaces of the second protruding portions 1423 so as to be engaged with different recesses 1424. During this situation, the inner sleeve 141 is rotated with respect to the outer sleeve 142. However, the present disclosure is not limited thereto. In other embodiments, the inner sleeve 141 can be rotated with respect to the outer sleeve through other mechanisms, such as, flexible members.

The driven shaft 15 is located between the first body 111 and the second body 112. The driven shaft 15 has a teeth portion 151 and a hollow portion. The teeth portion 151 is engaged with the worm gear 1425. The tilt rod 16 is disposed through the hollow portion of the driven shaft 15, and the tilt rod 16 is rotatably disposed through a through hole 113 formed by the first body 111 and the second body 112. The shape of the tilt rod 16 matches the shape of the hollow portion of the driven shaft 15, such that the tilt rod 16 and the driven shaft 15 can be firmly fixed with each other, and the tilt rod 16 is prevented from being rotated with respect to the driven shaft 15. The lift cords 40 are disposed on the tilt rod 16 and disposed through all the slats 50 so as to hang the slats 50 on one side of the headrail 10 and make them spaced apart from each other. In this embodiment, the cross sections of the tilt rod and the hollow portion both are rectangular, but the present disclosure is not limited thereto. In other embodiments, the cross sections of the hollow portion and the tilt rod can both be hexagonal.

The gears 131 of the two transmission shafts 13 are respectively engaged with two opposite ends of the inner gear 121 of the spool 12, and the two worm gears 1425 are respectively engaged with two opposite ends of the driven shaft 15. Thus, the two transmission shafts 13 and the two transmission sleeve sets 14 can rotate harmoniously to stabilize the transmission among the spool 12, the transmission shafts 13, the transmission sleeve sets 14 and the driven shaft 15.

In this embodiment, the tilt mechanism 10*a* has two transmission shafts 13 and two transmission sleeve sets 14, but the present disclosure is not limited thereto. In other embodiments, the quantity of the transmission shaft 13 and the quantity of the transmission sleeve set 14 in the tilt mechanism can be adjusted.

Figure 5:
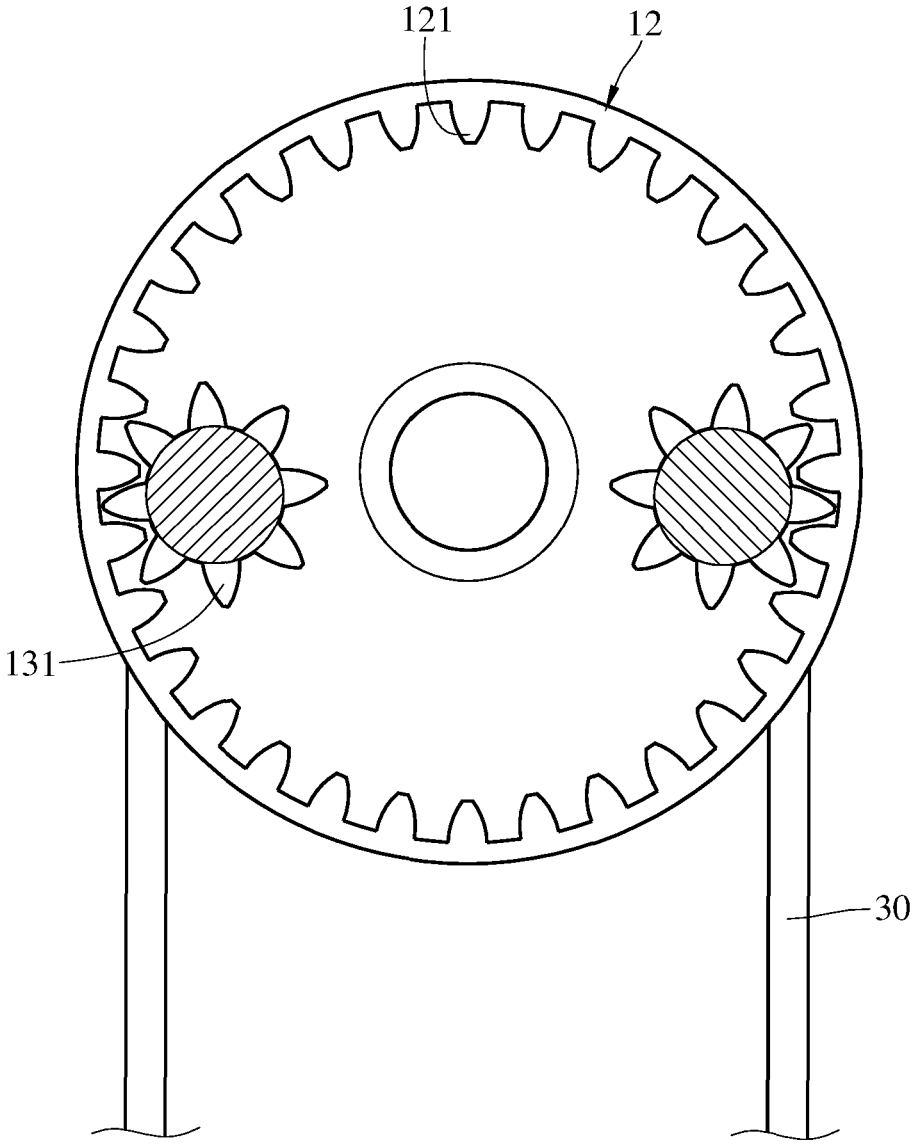
FIG. 5 is a cross-sectional view of a draw cord coiled on a spool in FIG. 1.
Figure 6:
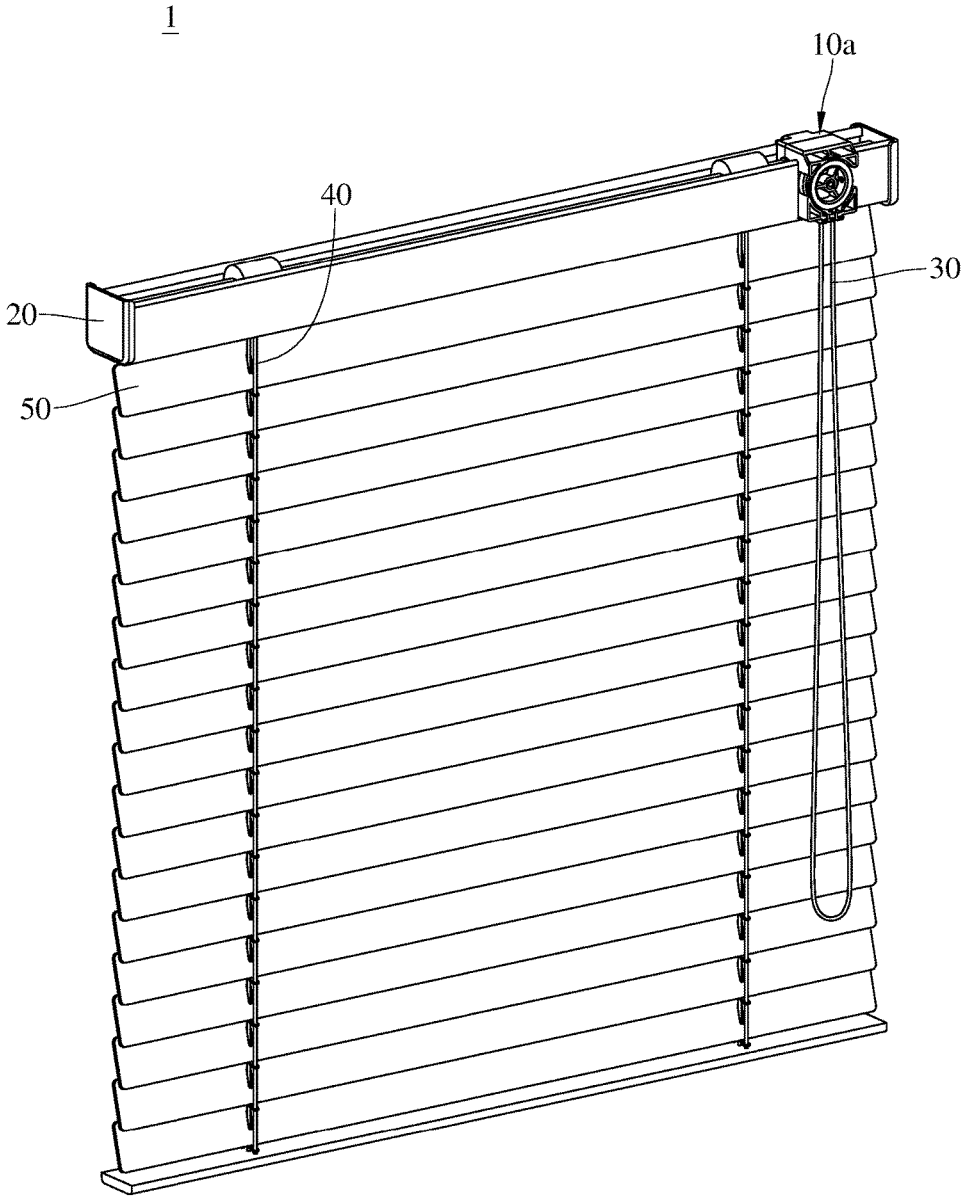
FIG. 6 is a perspective view of the blind with the slats in a fully closed position in FIG. 1.
Figure 7:
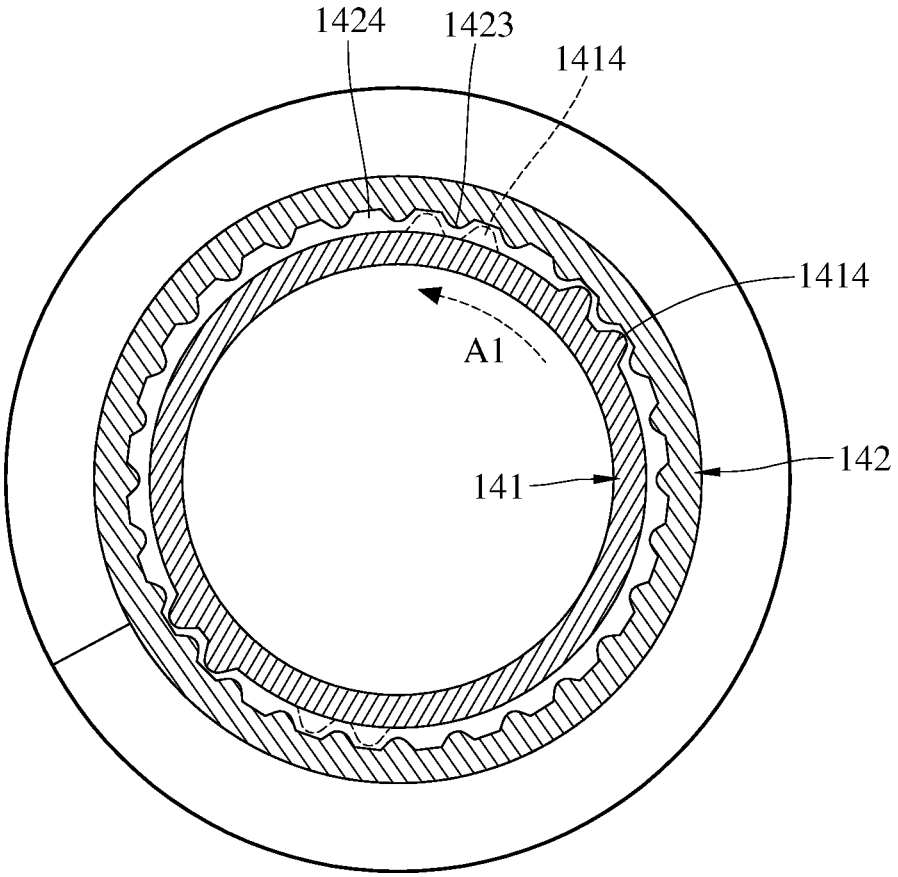
FIG. 7 is a cross-sectional view showing first protruding portions of the inner sleeve sliding over recesses of the outer sleeve.

The operation of the blind is described in the following paragraphs. Please refer to FIG. 1 and further refer to FIG. 5 to FIG. 7. FIG. 5 is a cross-sectional view of a draw cord coiled on a spool in FIG. 1, FIG. 6 is a perspective view of the blind with the slats in a fully closed position in FIG. 1, and FIG. 7 is a cross-sectional view showing a first protruding portion of the inner sleeve sliding over recesses of the outer sleeve. Firstly, as shown in FIG. 1, the slats 50 of the blind 1 are fully opened (i.e. the slats 50 are in the fully opened position). Then, the user can pull the draw cord 30 to close the slats 50. In detail, as shown in FIG. 5, when the user pulls the draw cord 30 to rotate the spool 12 along a close direction A1, the spool 12 is rotated to drive the transmission shaft 13 and the inner sleeves 141 to rotate. Before fully closing the slats 50, the outer sleeve 142 is not restricted by the driven shaft 15, so if the torque from the inner sleeves 141 applying on the outer sleeves 142 is smaller than the restricting force of the recesses 1424 applying on the first protruding portions 1414, the outer sleeve 142 will be rotated simultaneously with the inner sleeve 141. Then, as shown in FIGS. 6-7, when the slats 50 are fully closed, the driven shaft 15 is unable to be rotated along the close direction A1, so the outer sleeve 142 is restricted to rotate by the driven shaft 15. At this point, if the user keeps pulling the draw cord 30 to rotate the spool 12, the torque that the inner sleeve 141 applies on the outer sleeve 142 becomes larger than the restricting force that the recesses 1414 apply on the first protruding portions 1414. As a result, the first protruding portions 1414 is forced to slide over the curved surface of the second protruding portions 1423 to engage with different recesses 1424. In other words, the inner sleeve 141 is idled with respect to the outer sleeve 142, such that the outer sleeve 142 is not able to be driven by the inner sleeve 141. Accordingly, the worm gear 1425 of the outer sleeve 142 is prevented from hitting the teeth portion 151 of the driven shaft 15.

Figure 8:
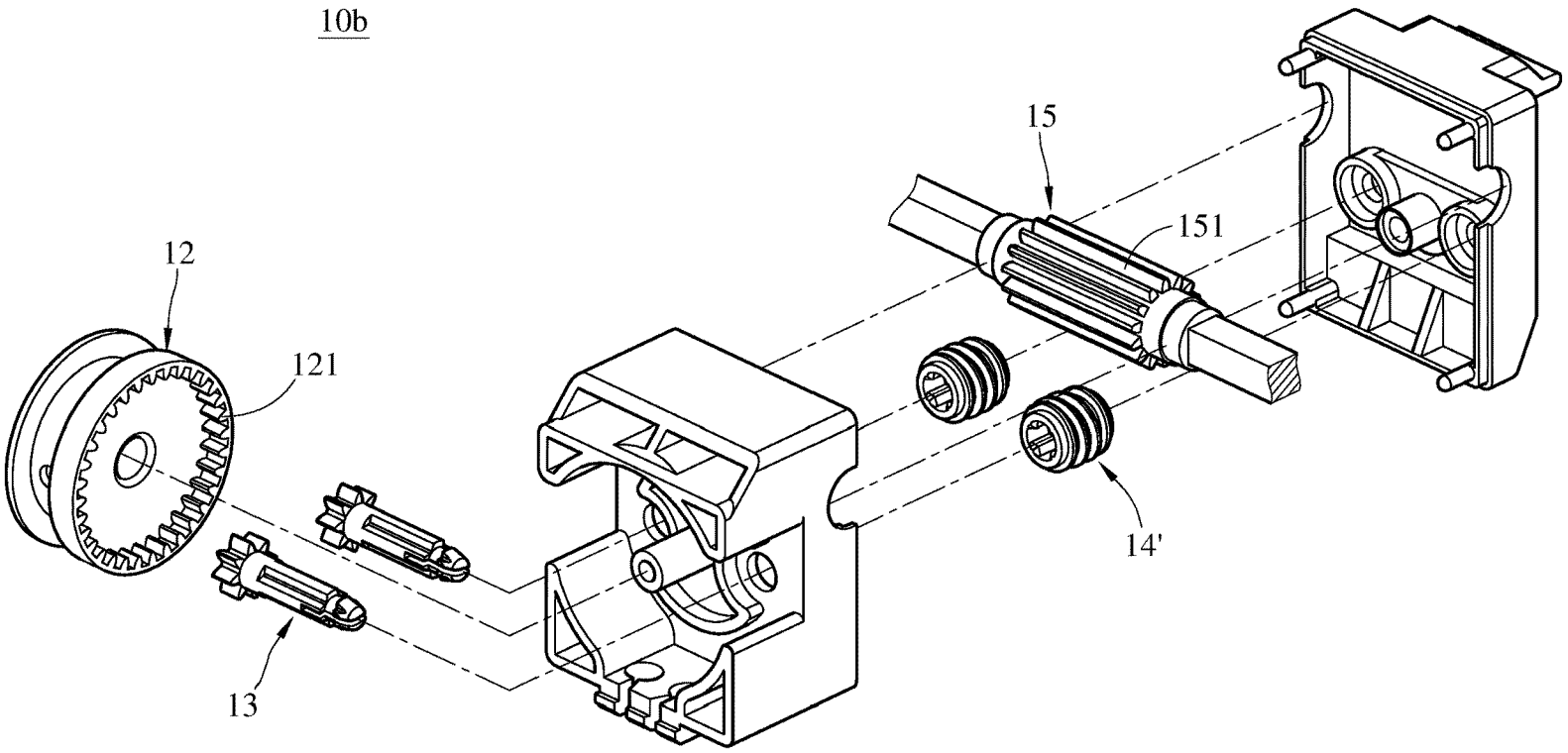
FIG. 8 is an exploded view of a tilt mechanism in accordance with another embodiment of the disclosure.

In the former embodiment, the transmission sleeve set 14 of the tilt mechanism 10*a* includes the inner sleeve 141 and the outer sleeve 142, but the present disclosure is not limited thereto. Please refer to FIG. 8. FIG. 8 is an exploded view of a tilt mechanism in accordance with another embodiment of the disclosure. In this embodiment, a tilt mechanism 10*b* is provided. The tilt mechanism 10*b* includes a spool 12, two transmission shafts 13, two transmission sleeves 14', and a driven shaft 15. Each transmission sleeve 14' is a single piece that is inseparable. There is no idling gap between the transmission shafts 13 and the transmission sleeves 14', so they are perfectly engaged with each other and can work harmoniously.

According to the blind and the tilt mechanism thereof as discussed above, the inner sleeve of the tilt mechanism is rotatable with respect to the outer sleeve or rotatable simultaneously with the outer sleeve: when the driven shaft is rotated between the start position and the stop position, the inner sleeve is rotated simultaneously with the outer sleeve; when the driven shaft is in the stop position, and the transmission shaft is kept rotated along the operating direction by the spool, the inner sleeve is able to be rotated with respect to the outer sleeve, thereby preventing the worm gear on the outer sleeve from hitting with the teeth portion of the driven shaft. As a result, the lifespan of the blind is extended.

In addition, the gear of the transmission shaft are respectively engaged with two opposite ends of the inner gear of the spool, and the worm gear are respectively engaged with two opposite ends of the driven shaft. Thus, there is no idling gap between the two transmission shafts and the two transmission sleeve sets, so they can perfectly engaged with each other and can work harmoniously.

What is claimed is:

1. A tilt mechanism for a blind, comprising:

a base; and a spool, rotatably disposed on the base, and the spool having an inner gear;

at least one transmission shaft, rotatably disposed on the base, the at least one transmission shaft comprising an assembling portion and a gear, and the gear being located at one end of the at least one transmission shaft and engaged with the inner gear;

at least one transmission sleeve set, comprising an inner sleeve and an outer sleeve, the inner sleeve disposed on the assembling portion, the outer sleeve sleeved on the inner sleeve, the inner sleeve rotatable with respect to the outer sleeve or rotatable simultaneously with the outer sleeve, and the outer sleeve having an outer surface and a worm gear located at the outer surface thereof; and a driven shaft, having a teeth portion, and the teeth portion being engaged with the worm gear;

wherein the at least one transmission shaft and the at least one transmission sleeve set are simultaneously rotatable by the spool, and the driven shaft is rotatable between a start position and a stop position along an operating direction by being driven by the at least one transmission sleeve set; when the driven shaft is rotated to the stop position and the at least one transmission shaft continues to be rotated by the spool, the inner sleeve is rotated with respect to the outer sleeve.

2. The tilt mechanism according to claim 1, wherein the inner sleeve has an outer surface, the outer sleeve has an inner surface, the outer surface of the inner sleeve faces the inner surface of the outer sleeve, and the outer surface of the inner sleeve has at least one first protruding portion, the inner surface of the outer sleeve has a plurality of second protruding portions and a plurality of recesses formed between the plurality of second protruding portions, a height of each of the plurality of second protruding portions from the inner surface of the outer sleeve is smaller than a height of the at least one first protruding portion from the outer surface of the inner sleeve, and the at least one protruding portion is located in one of the plurality of recesses.

3. The tilt mechanism according to claim 2, wherein each of the at least one first protruding portion and the plurality of second protruding portions have a curved surface.

4. The tilt mechanism according to claim 1, wherein both an amount of the at least one transmission shaft and an amount of the at least one transmission sleeve set are two, and the gears of the transmission shafts are respectively engaged with two opposite sides of the inner gear of the spool, and the worm gears are respectively engaged with two opposite ends of the driven shaft.

5. The tilt mechanism according to claim 1, wherein the at least one transmission shaft further includes an engaged portion and a pivoting portion, the engaged portion is located at an end of the at least one transmission shaft opposite to the gear, the pivoting portion is located between the gear and the engaged portion, and the pivoting portion is connected to the assembling portion.

6. The tilt mechanism according to claim 1, wherein the assembling portion has a key structure.

7. A blind, comprising:

a headrail;

a tilt mechanism, disposed on the headrail, comprising:

a base;

a spool, rotatably disposed on the base, and the spool having an inner gear;

at least one transmission shaft, rotatably disposed on the base, the at least one transmission shaft comprising an assembling portion and a gear, and the gear being located at one end of the at least one transmission shaft and engaged with the inner gear;

at least one transmission sleeve set, comprising an inner sleeve and an outer sleeve, the inner sleeve disposed on the assembling portion, the outer sleeve sleeved on the inner sleeve, the inner sleeve rotatable with respect to the outer sleeve or rotatable simultaneously with the outer sleeve, the outer sleeve having an outer surface and a worm gear located at the outer surface thereof; and a driven shaft, having a teeth portion, and the teeth portion being engaged with the worm gear;

at least one lift cord, disposed on the tilt mechanism; and a plurality of slats, the at least one lift cord connected to all the plurality of slats to make the slats to be hanged on one side of the headrail and spaced apart from each other;

wherein the at least one transmission shaft and the at least one transmission sleeve set are simultaneously rotatable by being driven by the spool, and the driven shaft is rotatable between a start position and a stop position along an operating direction by being driven by the at least one transmission sleeve set; when the driven shaft is rotated to the stop position and the at least one transmission shaft continues to be rotated by the spool, the inner sleeve is rotated with respect to the outer sleeve.

8. The blind according to claim 7, wherein the inner sleeve has an outer surface, the outer sleeve has an inner surface, the outer surface of the inner sleeve faces the inner surface of the outer sleeve, and the outer surface of the inner sleeve has at least one first protruding portion, the inner surface of the outer sleeve has a plurality of second protruding portions and a plurality of recesses formed between the plurality of second protruding portions, a height of the plurality of second protruding portion from the inner surface of the outer sleeve is smaller than a height of the at least one first protruding portion from the outer surface of the inner sleeve, and the at least one protruding portion is located in one of the plurality of recesses.

9. The blind according to claim 7, wherein both an amount of the at least one transmission shaft and an amount of the at least one transmission sleeve set are two, and the gears of the transmission shafts are respectively engaged with two opposite sides of the inner gear of the spool, and the worm gears are respectively engaged with two opposite ends of the driven shaft.

10. The blind according to claim 7, further comprising a tilt rod and a draw cord, the tilt rod is disposed through the driven shaft, and is rotatably disposed on the base, the draw cord is coiled on the spool.

11. A tilt mechanism for a blind, comprising:

a base;

a spool, rotatably disposed on the base, the spool having an inner gear;

two transmission shafts, rotatably disposed on the base, each of the two transmission shafts having an assembling portion and a gear, the gears being engaged with the inner gear;

two transmission sleeves, being respectively engaged with the two assembling portions, and each of the transmission sleeves having an outer surface and a worm gear located at the outer surface thereof; and a driven shaft, having a teeth portion, and the teeth portion being engaged with the two worm gears;

wherein the two transmission shafts and the two transmission sleeves are simultaneously rotatable by being driven by the spool, and the driven shaft is rotatable between a start position and a stop position along an operating direction by being driven by the transmission sleeves.

* * * * *